United States Patent [19]

Peck

[11] Patent Number: 4,800,609

[45] Date of Patent: Jan. 31, 1989

[54] BLEACHER SEAT DUST MOP

[76] Inventor: William L. Peck, 6036 Dolly Varden, South Charleston, Ohio 45368

[21] Appl. No.: 155,471

[22] Filed: Feb. 12, 1988

[51] Int. Cl.[4] ..... A47L 13/252

[52] U.S. Cl. ..... 15/210 R; 15/160; 15/143 R; 15/229.8; D4/119

[58] Field of Search ..... 15/229.1–229.9, 15/160, 228, 147 R, 147 A, 147 B, 147 C, 147 D, 143 R, 148–154, 210 R; D4/119, 120, 130–136

[56] References Cited

U.S. PATENT DOCUMENTS

| | | | |
|---|---|---|---|
| 1,349,680 | 8/1920 | Link | 15/229.3 |
| 1,735,278 | 11/1929 | Hertzberg | 15/229.9 |
| 1,784,567 | 12/1930 | Aultman | 15/160 |
| 2,062,065 | 11/1936 | Miley | 15/229.3 |
| 2,878,504 | 3/1959 | Godfrey | 15/210 R |
| 2,898,619 | 8/1959 | Beck | 15/229.9 X |
| 3,837,031 | 9/1974 | Allaire et al. | 15/150 |

*Primary Examiner*—Peter Feldman

*Attorney, Agent, or Firm*—Fleit, Jacobson, Cohn & Price

[57] ABSTRACT

A dust mop is provided including a horizontally elongated head assembly and incorporating at least one pair of elongated, longitudinally extending and spaced apart primary mop head sections. The primary mop head sections are vertically spaced apart and interconnected by an inclined connecting section extending and secured therebetween. The horizontal and vertical spacing between the primary sections coincides with the horizontal and vertical spacing between adjacent bleacher row seats and the mop head has one end of a handle pivotally supported from the inclined connecting section thereof.

7 Claims, 1 Drawing Sheet

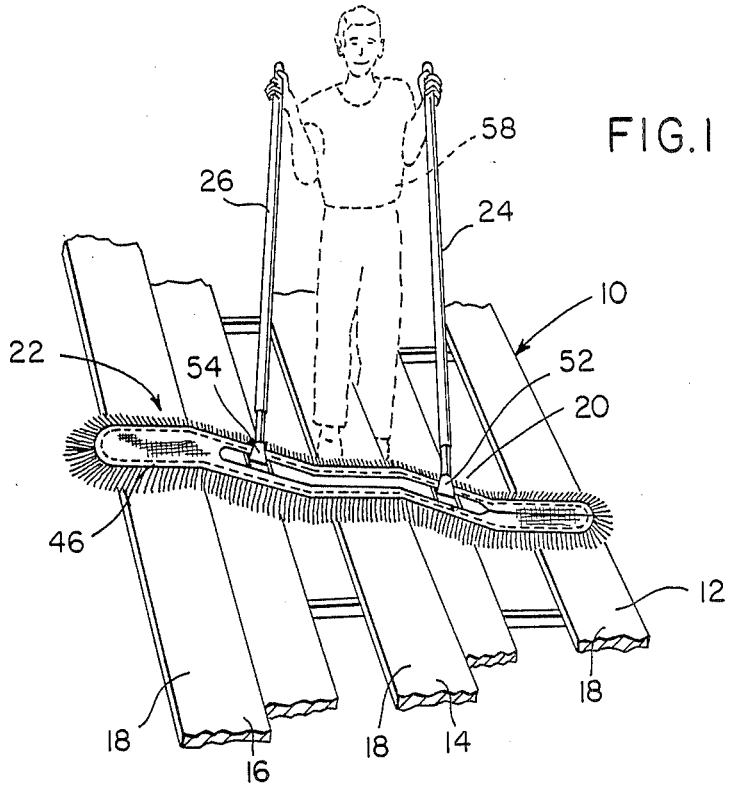
FIG. 1
FIG. 2
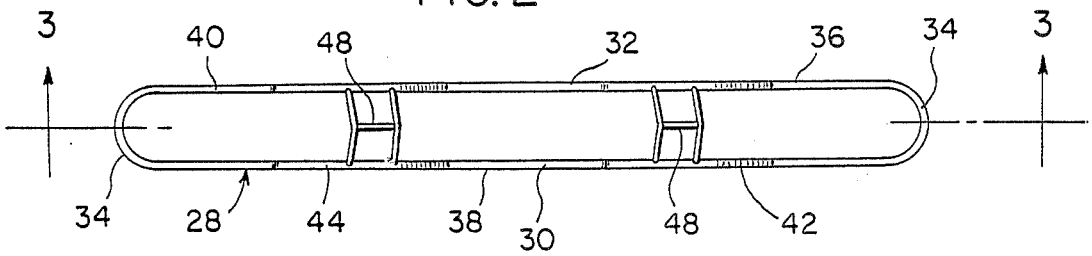
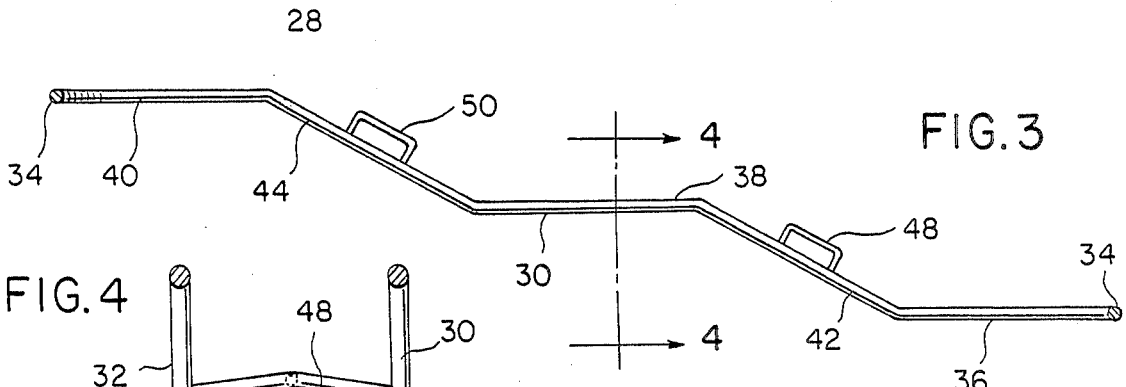
FIG. 3
FIG. 4
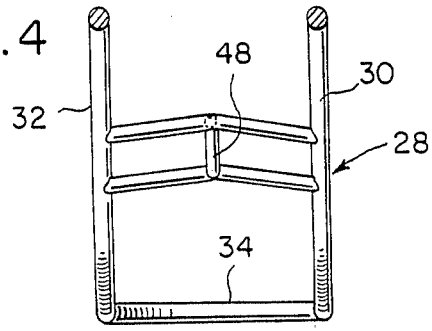

BLEACHER SEAT DUST MOP

BACKGROUND OF THE INVENTION

1. FIELD OF THE INVENTION

This invention relates to a dust mop including elongated, longitudinally spaced apart and vertically spaced horizontal mop head sections for simultaneous movement along and dusting the upper surfaces of adjacent rows of bleacher seats.

2. DESCRIPTION OF RELATED ART

Various different forms of mop heads including multiple sections and other basic structural features of the instant invention heretofore have been provided. Examples of these previously known structures are disclosed in U.S. Pat. Nos. 1,349,680, 2,062,065, 2,252,407, 2,725,586, 2,756,453, 2,878,504 and 2,898,619.

However, these previously known mop structures do not include the overall combination of structural and operational features of the instant invention

SUMMARY OF THE INVENTION

The mop head of the instant invention comprises a horizontally elongated structure including at least two elongated, longitudinally extending and longitudinally spaced apart horizontal primary mop head sections. The primary mop head sections further are vertically spaced apart and adjacent ends of adjacent primary mop head sections are interconnected by an elongated, inclined mop head connecting section extending and secured therebetween.

The overall mop head incorporates a one piece, non-articulated frame and is covered by a single tubular dusting attachment sleeve telescopingly engaged over the head frame from one end thereof, although other types of dusting attachments could be used.

The horizontal and vertical spacing between adjacent primary sections of the mop head is substantially equal to the horizontal and vertical spacing between adjacent rows of bleacher seats and the mop head may be provided with either a single pivoted handle or multiple pivoted handles attached to the mop head at longitudinally spaced sections of the frame thereof.

The main object of this invention is to provide a dusting mop which may be conveniently used to simultaneously dust the upper surfaces of a plurality of adjacent rows of bleacher seats.

Another object of this invention is to provide a dusting mop in accordance with the preceding objects and constructed in a manner whereby slightly modified conventional dusting sleeves may be used in conjunction therewith.

Still another important object of this invention is to provide a dusting mop specifically designed for use in conjunction with bleacher seats and which may be readily handled, by even inexperienced persons.

A final object of this invention to be specifically enumerated herein is to provide a dusting mop for bleacher seats in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

FIG. 1 is a fragmentary perspective view of three adjacent rows of bleacher seats with a bleacher seat dusting mop constructed in accordance with the present invention operatively associated therewith;

FIG. 2 is an enlarged top plan view of the dusting mop frame of the instant invention;

FIG. 3 is a further enlarged vertical sectional view taken substantially upon the plane indicated by the section line 3—3 of FIG. 2; and FIG. 4 is an enlarged vertical sectional view taken substantially upon the plane indicated by the section line 4—4 of FIG. 3.

DESCRIPTION OF THE PREFERRED EMBODIMENT

Referring now more specifically to the drawings the numeral 10 generally designates a bleacher seat assembly including three horizontally and vertically spaced bleacher seat rows 12, 14 and 16. As may be seen from FIG. 1, the bleacher seat rows 12, 14 and 16 include upper surfaces 18 which are horizontally disposed, horizontally spaced apart and also vertically spaced apart.

The bleacher seat dust mop of the instant invention is referred to in general by the reference numeral 20 and includes a horizontally elongated head referred to in general by the reference numeral 22 and a pair of handles 24 and 26. The head 22 includes a horizontally elongated frame referred to in general by the reference numeral 28 and the frame 28 includes front and rear longitudinal side bars 30 and 32 which are laterally spaced apart and corresponding ends of the bars 30 and 32 are interconnected by integral semi-circular end members 34.

As may be seen from FIG. 2, the frame 28 is long and narrow in plan and from FIG. 3 may be seen that the frame 28 includes three elongated, longitudinally spaced apart and vertically spaced apart primary frame sections 36, 38 and 40 and that the sections 36 and 38 are interconnected by an elongated and longitudinally extending inclined connecting section 42 extending and connected therebetween while the adjacent ends of the sections 38 and 40 are interconnected by a similar connecting section 44 extending therebetween.

The sections 36, 38 and 40 are each slightly longer than the width of the bleacher seat rows 12, 14 and 16 and the horizontal and vertical spacing between the sections 36, 38 and 40 is substantially identical to the horizontal and vertical spacing between the upper surfaces 18 of the bleacher seat rows 12, 14 and 16.

The mop head 22, in addition to the frame 28, includes an elongated tubular dusting sleeve 46 telescoped and removably secured thereover from one end of the head 22 and the frame 28 includes longitudinally spaced handle mounts 48 and 50 carried by the connecting sections 42 and 44, respectively. The handle mounts 48 and 50 are substantially conventional in design and corresponding ends of the handles 24 and 26 include pivot mounts 52 and 54, respectively, which are of conventional design and releasably pivotally connect corresponding handle ends to the mounts 48 and 50.

The handles 24 and 26 are pivotally secured to the handle mounts 48 for oscillation relative thereto about axis extending generally longitudinally of the head 22 and transversely of the handles 24 and 26.

From FIG. 1 of the drawings, it may be seen that the mop 20 may be used by a work person 58 to simultaneously mop the upper surfaces 18.

If only a pair of primary frame sections are provided in conjunction with a single connecting section, only one handle need be used. Further, if the bleacher seat assembly 10 incorporates a large number of rows, it would be possible to add one more connecting section as well as an additional primary section to the frame 28, whereby the mop 10 could be used to simultaneously dust four adjacent bleacher seat rows and in which instance a pair of handles such as the handles 24 and 26 could be pivotally mounted from the middle pair of adjacent primary frame sections.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A bleacher seat dust mop including a horizontally elongated head assembly and at least a first elongated handle pivotally mounted at one end to an intermediate length mid-portion of said head assembly for angular displacement of said handle relative to said head assembly about an axis extending generally longitudinally of said head assembly and transversely of said handle, said head assembly including at least one pair of elongated primary sections longitudinally spaced apart along said head assembly and extending longitudinally therealong, said primary sections being horizontally disposed and vertically offset relative to each other a vertical distance generally equal to the vertical spacing between the upper surface levels of adjacent bleacher seat rows, adjacent ends of said elongated primary sections being interconnected by an elongated inclined head assembly connecting section connected and extending therebetween, said handle one end being pivotally mounted from said inclined connecting section.

2. The mop of claim 1 wherein said primary and connecting sections of said head assembly are rigidly interconnected.

3. The mop of claim 1 wherein said head assembly includes a lengthwise extending open rectangular frame, said sections comprising longitudinally spaced portions of said frame, said frame including an elongated dusting member extending longitudinally thereof and removably supported therefrom.

4. The mop of claim 3 wherein said dusting member comprises a tubular dusting sleeve telescopingly engaged over said frame from one end thereof.

5. The mop of claim 1 wherein said head includes three horizontal and vertically spaced elongated primary sections spaced apart longitudinally thereof and a pair of inclined connecting sections, each connecting section extending between and interconnecting a pair of adjacent primary sections, said handle being pivotally mounted from one of said inclined sections, and a second handle pivotally mounted from the other of said connecting sections.

6. The mop of claim 5 wherein said handles are removably pivotally mounted from said connecting sections and said head assembly includes a lengthwise extending open rectangular frame, said sections comprising longitudinally spaced portions of said frame, said frame including an elongated dusting member removably supported therefrom.

7. The mop of claim 6 wherein said dusting member comprises an elongated dusting sleeve telescopingly engaged over said frame from one end thereof.

* * * * *